US006739784B1

(12) United States Patent
Tims et al.

(10) Patent No.: US 6,739,784 B1
(45) Date of Patent: May 25, 2004

(54) BINDER, NOTEBOOK OR PORTFOLIO WITH COVER RETAINING MECHANISM

(75) Inventors: J. Michael Tims, Kettering, OH (US); Thomas Joseph Africa, Lebanon, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/461,746

(22) Filed: Jun. 13, 2003

(51) Int. Cl.[7] ..... B42F 13/00

(52) U.S. Cl. ..... 402/73; 229/67.1; 281/15.1; 281/29; 281/31; 402/4; 402/57; 402/80 R; D19/26; D19/27

(58) Field of Search ..... 402/4, 57, 73, 402/80 R, 80 P, 500, 502; D19/26, 27; 229/67.1, 67.3, 67.4; 281/15.1, 29, 31, 36–38, 45, 51

(56) References Cited

U.S. PATENT DOCUMENTS

| | | | | |
|---|---|---|---|---|
| 3,142,495 A | | 7/1964 | Lu | |
| 4,838,724 A | | 6/1989 | Spence, Jr. | |
| 5,242,237 A | | 9/1993 | Wagner | |
| 5,380,043 A | | 1/1995 | Schwartz | |
| 5,911,441 A | * | 6/1999 | Yamamoto et al. | 281/15.1 |
| 5,913,541 A | | 6/1999 | Chen | |
| D424,615 S | * | 5/2000 | Wyant | D19/32 |
| 6,095,564 A | * | 8/2000 | Wien | 281/15.1 |
| 6,161,979 A | * | 12/2000 | Yamamoto et al. | 402/73 |
| 6,213,670 B1 | | 4/2001 | Wien | |
| 6,367,842 B1 | | 4/2002 | Wien et al. | |
| 6,371,679 B1 | | 4/2002 | Peleman | |
| 6,394,497 B1 | * | 5/2002 | Ho | 281/29 |
| 6,431,779 B1 | | 8/2002 | Moor et al. | |
| 6,478,154 B2 | | 11/2002 | Cliff et al. | |
| 6,558,062 B1 | * | 5/2003 | Wyant et al. | 402/73 |
| 2002/0051677 A1 | | 5/2002 | Moor et al. | |

* cited by examiner

*Primary Examiner*—Monica S. Carter
(74) *Attorney, Agent, or Firm*—Thompson Hine LLP

(57) ABSTRACT

A binder, notebook or portfolio including a body having a front cover and a rear cover pivotally joined together and a retaining mechanism located on an outer surface of the body. The retaining mechanism includes a pair of panels coupled to the body, the panels being releasably attachable together. In another embodiment, the invention is a binder, notebook or portfolio including a body having a front cover and a rear cover pivotally joined together and a retaining mechanism located on an outer surface the body. The retaining mechanism includes a pair of panels pivotally coupled to the body such that loose components can be located between the panels and the outer surface.

28 Claims, 6 Drawing Sheets

BINDER, NOTEBOOK OR PORTFOLIO WITH COVER RETAINING MECHANISM

The present invention is directed to a binder, notebook or portfolio having a retaining mechanism, and more particularly to a binder, notebook or portfolio having a retaining mechanism located on an outer surface thereof.

BACKGROUND

Binders, portfolios, notebooks and the like are often used by businesses, students, etc. in order to store loose items and provide a convenient carrying device. However, many existing binders, portfolios or notebooks may have limited storage surface and may in particular lack storage space on an outer space of the binder.

SUMMARY

The present invention is a binder, notebook or portfolio with a retaining mechanism located on an outer surface thereof. In particular, the retaining mechanism may include a pair of opposed panels pivotally coupled to the outer surface thereof, the panels being releasably attachable together. In one embodiment, the invention is a binder, notebook or portfolio including a body having a front cover and a rear cover pivotally joined together and a retaining mechanism located on an outer surface of the body. The retaining mechanism includes a pair of panels coupled to the body, the panels being releasably attachable together.

In another embodiment, the invention is a binder, notebook or portfolio including a body having a front cover and a rear cover pivotally joined together and a retaining mechanism located on an outer surface the body. The retaining mechanism includes a pair of panels pivotally coupled to the body such that loose components can be located between the panels and the outer surface.

Other objects and advantages of the present invention will be apparent from the following description and the accompanying drawings.

DETAILED DESCRIPTION

Figure 1:
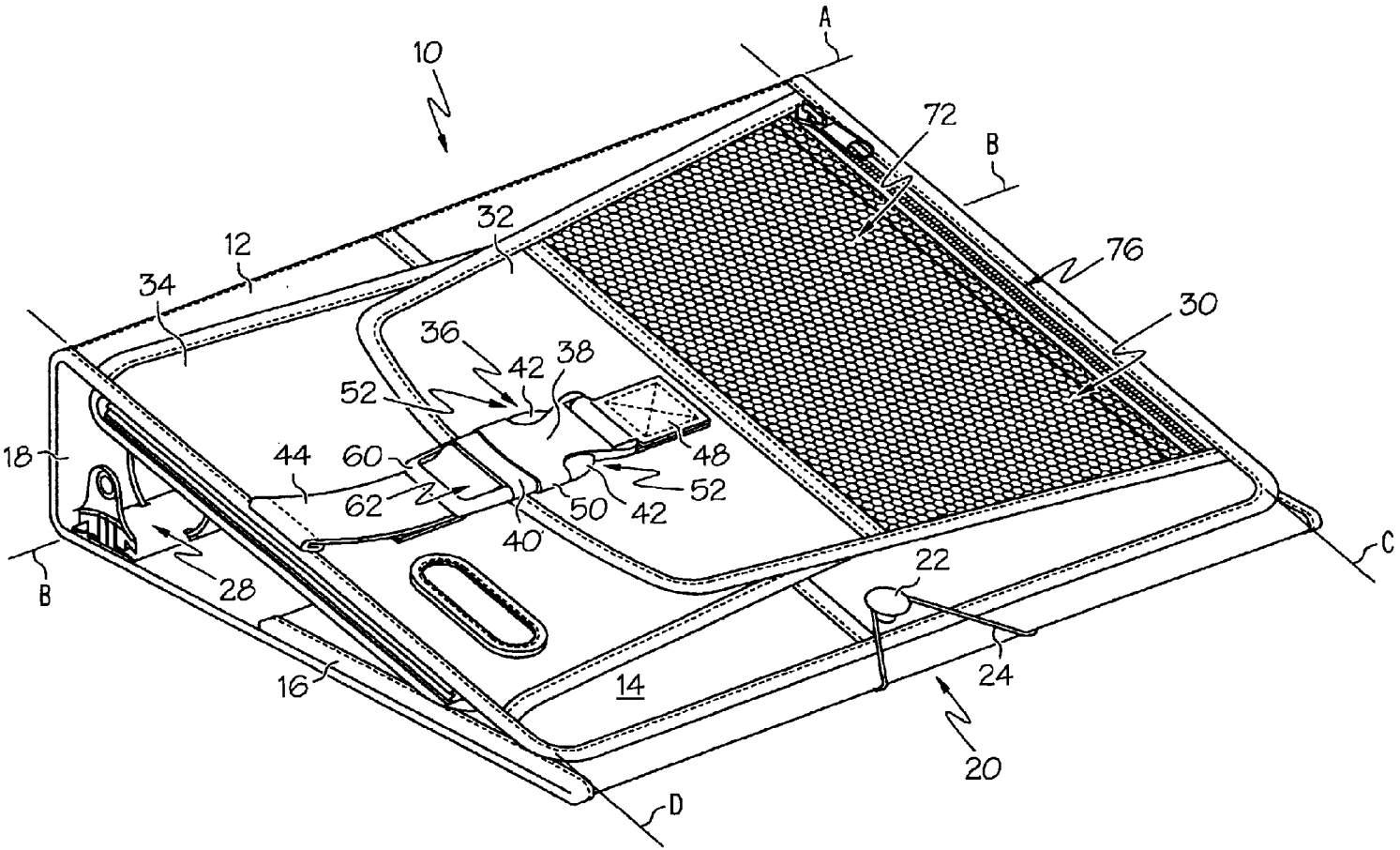
FIG. 1 is a front perspective view of one embodiment of the binder of the present invention, the retaining mechanism in its closed position and the clasp joined.

As shown in FIG. 1, in one embodiment, the binder of the present invention, generally designated 10, may include a binder body 12 having a front cover 14 and a rear cover 16 pivotally joined together. The binder body 12 may include a spine portion 18 located between the front 14 and the rear covers 16, with each of the front 14 and rear 16 covers being pivotally coupled to the spine portion 18. For example, the front cover 14 may be pivotable about a hinge line A, and the rear cover 16 may be pivotable about hinge line B.

The binder 10 may include a closure device, generally designated 20, which can releasably couple the front 14 and rear 16 covers together at an edge opposite the spine 18 to retain the binder 10 in its closed position wherein the covers 14, 16 face each other and are generally parallel. In the illustrated embodiment, the closure device 20 includes a rivet 22 located on the front cover 14 and a loop 24 of elastic material coupled to the rear cover 16 such that the loop 24 can be fit around the rivet 22 to maintain the cover binder 10 in its closed position. However, a wide variety of retaining devices, including but not limited to hooks, fasteners, clasps, zippers, hook and loop fastening systems, snaps and the like may be used as or in the place of the closure device 20 without departing from the scope of the present invention.

Figure 6:
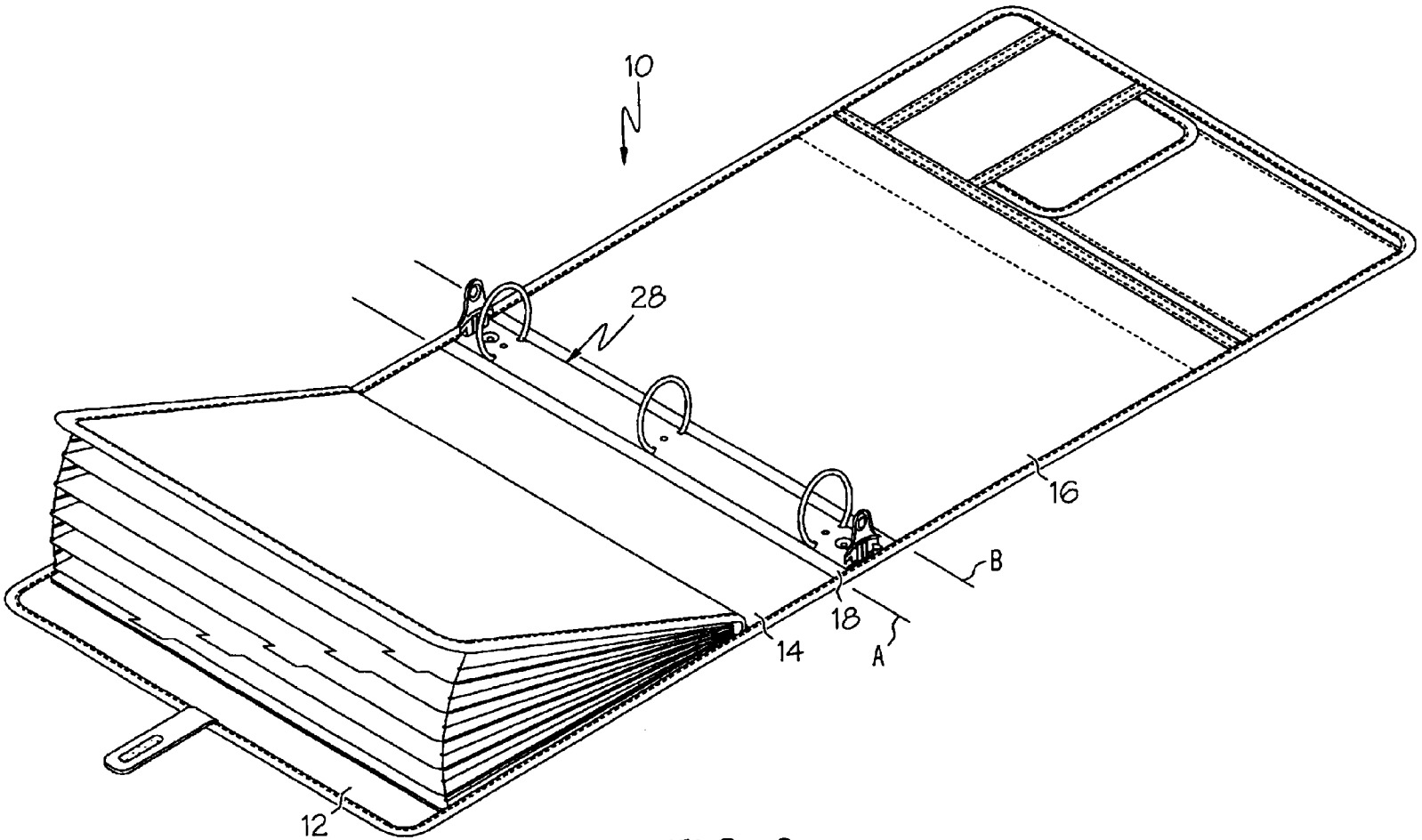
FIG. 6 is a front perspective view of the binder of FIG. 1, with the binder in its open position.

As shown in FIG. 6, when the closure device 20 is moved to its separated position such that the loop 24 is separated from the rivet 22, the front 14 and/or rear 16 covers can be pivoted to open the binder 10. In the illustrated embodiment, the binder 10 includes a binding mechanism 28, such as a three-ring binding mechanism, located on the inner surface of the binder body 12 such that papers, notebooks and the like may be coupled to the binding mechanism 28 and binder 10. The binder body 12 may include a wide variety of binding mechanisms, pockets, slots and the like on its inner or outer surfaces for storing a wide variety of school and business products.

Figure 2:
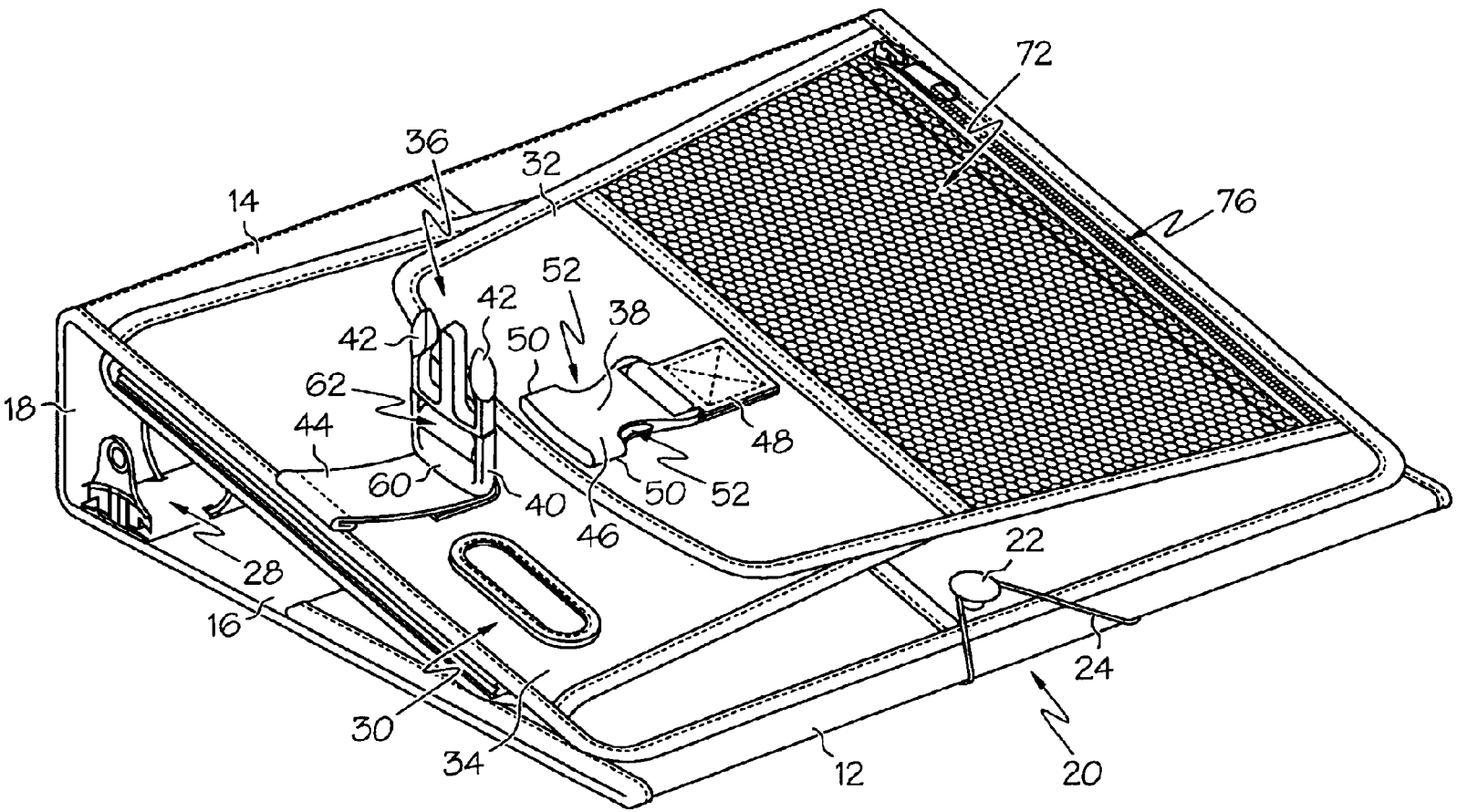
FIG. 2 is a front perspective view of the binder of FIG. 1, with the clasp separated.

As shown in FIG. 1, the binder 10 may include a retaining mechanism 30 located on or coupled to an outer surface thereof. In the illustrated embodiment, the retaining mechanism 30 includes a pair of panels 32, 34 located on and coupled to the front cover 14 and an attachment mechanism 36 for releasably attaching the panels 32, 34 together. In the illustrated embodiment, an attachment mechanism 36 includes a pair of interlockable clasp components 38, 40. For example, as shown in FIG. 2, the attachment mechanism 36 may include a male clasp component 40 having a set of prongs 42, the male clasp component 40 being coupled to the lower panel 34 by a belt 44. Each of the outermost prongs 42 of the male clasp component 40 may include a curved tip, and may be generally inwardly deflectable. The attachment mechanism 36 may also include a female clasp component 40 that is coupled to the upper panel 34 by a belt 48. The female clasp component 46 may include a set of outer walls 50 and have a pair of opposed cutouts 52 formed therein.

In order to couple the clasp components 38, 40 together, the male clasp component 40 may be inserted into the female clasp component 38 such that the curved tips of the outer prongs 42 engage the outer wall 50 and are urged inwardly. Once the male clasp component 40 is inserted into a sufficient depth in the female clasp component 38, the prongs 42 spring outwardly and are at least partially received in the cutouts 52 of the female clasp component 38 to couple the clasp components 38, 40 together in a well-known manner. In order to uncouple the clasp components 38, 40, a user can squeeze the portions of the prong components 42 that are exposed through the openings 52 (i.e., by squeezing the prong components 42 between a thumb and forefinger) such that the male component 40 can then be retracted out of the female component 38.

At least one of the male 40 or female 38 clasp components may be coupled to an associated panel 32, 34 by an adjustable belt such that the effective length of the belt can be adjusted. For example, in the illustrated embodiment, the belt 44 that couples the male clasp component 40 to the lower panel 34 is looped around the base 60 of the clasp component 40. The belt 44 can be threaded through the loop 62 of the base 60 to increase or decrease the effective length of the belt 44 in a well-known manner. Of course, the female clasp component 38 can also or alternately be coupled to its associated panel 32 by an adjustable belt, and further alternately the locations of the male 40 and female 38 clasp components may be reversed. Furthermore, it should be understood that a wide variety of attachment mechanisms for coupling the upper 32 and lower 34 panels may be used without departing from the scope of the present invention, including but not limited to hooks, fasteners, clasps, zippers, hook and loop fastening systems, snaps, interengaging geometries and the like, which can allow the panels 32, 34 to be coupled together at various positions and angles.

Each of the panels 32, 34 may be pivotably coupled to an outer surface of the binder 10. For example, in the illustrated embodiment the upper panel 32 is pivotable about a hinge line C located generally adjacent to an upper edge of the front cover 14. The hinge line C may extend generally perpendicular to the spine 18, and generally perpendicular to the axes of rotation A, B of the front 14 and rear 16 covers. Similarly, the lower panel 34 may be pivotable about a hinge line D located generally adjacent to a lower edge of the front cover 14, and generally perpendicular to the spine 18 and hinge lines A, B.

Figure 3:
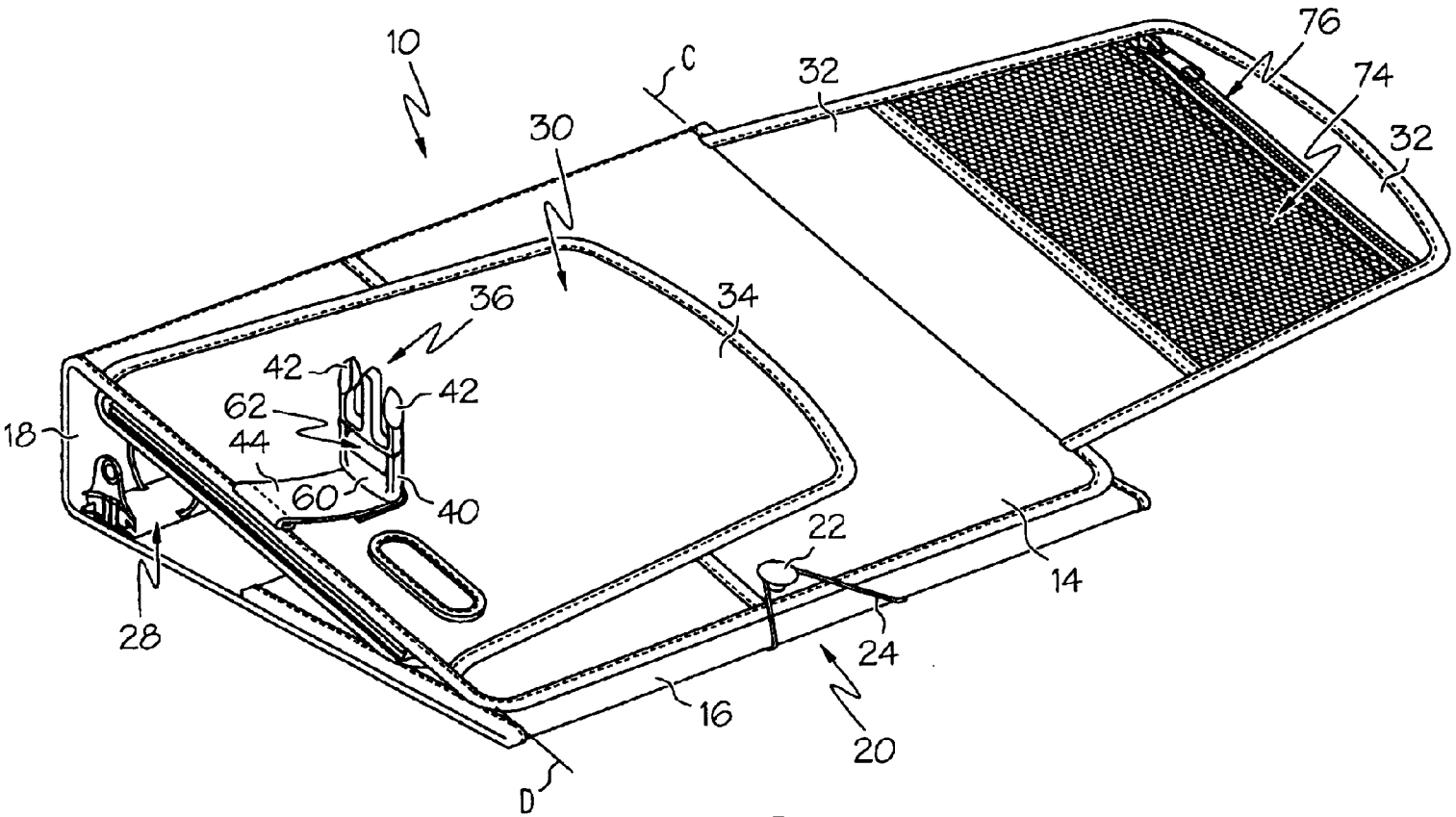
FIG. 3 is a front perspective view of the binder of FIG. 2, with the upper panel moved to its access position.

The upper panel 32 may be pivotable between a retaining position wherein the upper panel 32 is oriented generally parallel to and faces or is adjacent to the front cover 14 (FIG. 2), and an access position wherein the front panel 32 is not oriented generally parallel to the front cover 14, or is not facing or adjacent to the front cover 14 (FIG. 3). Although FIG. 3 illustrates the upper panel 32 in a parallel position such that the upper panel 32 has been pivoted about 180° about hinge line C, it should be understood that the upper panel 32 can be pivoted more or less than the illustrated 180°.

FIG. 3 illustrates the lower panel 34 in its retaining position wherein the lower panel 34 is oriented generally parallel to the front cover 14, and faces or is adjacent to the front cover 14. The lower panel 34 is pivotable about axis D to an access position (FIG. 4) such that the lower panel 34 is not oriented generally parallel and/or does not face or is not located generally adjacent to the front cover 14. In the illustrated embodiment, the panels 32, 34 may at least partially overlap when the panels are in their retaining position or the retaining mechanism 30 is in its retaining position, as shown in FIG. 2.

Figure 4:
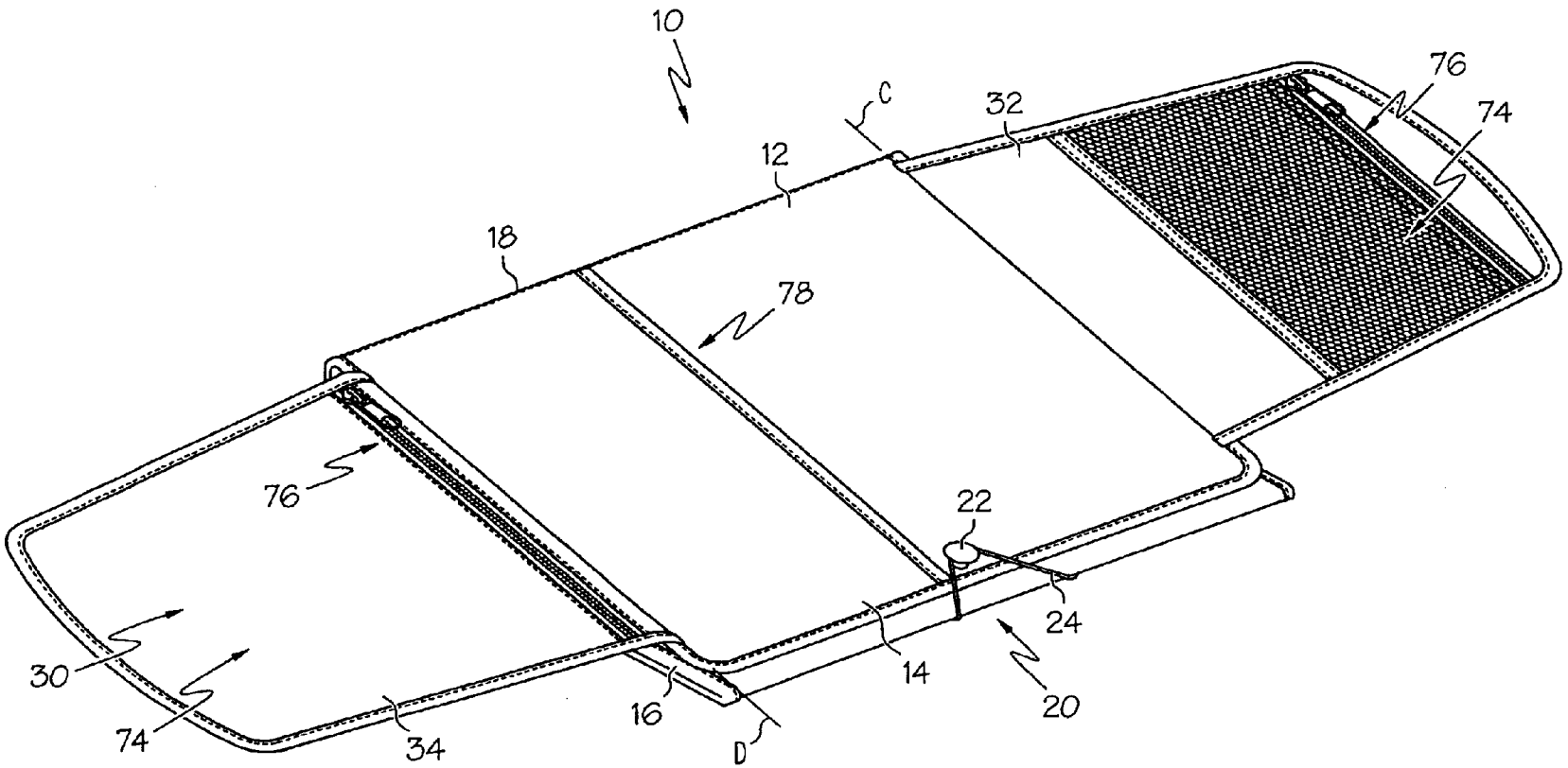
FIG. 4 is a front perspective view of the binder of FIG. 3, with the lower panel moved to its access position.
Figure 5:
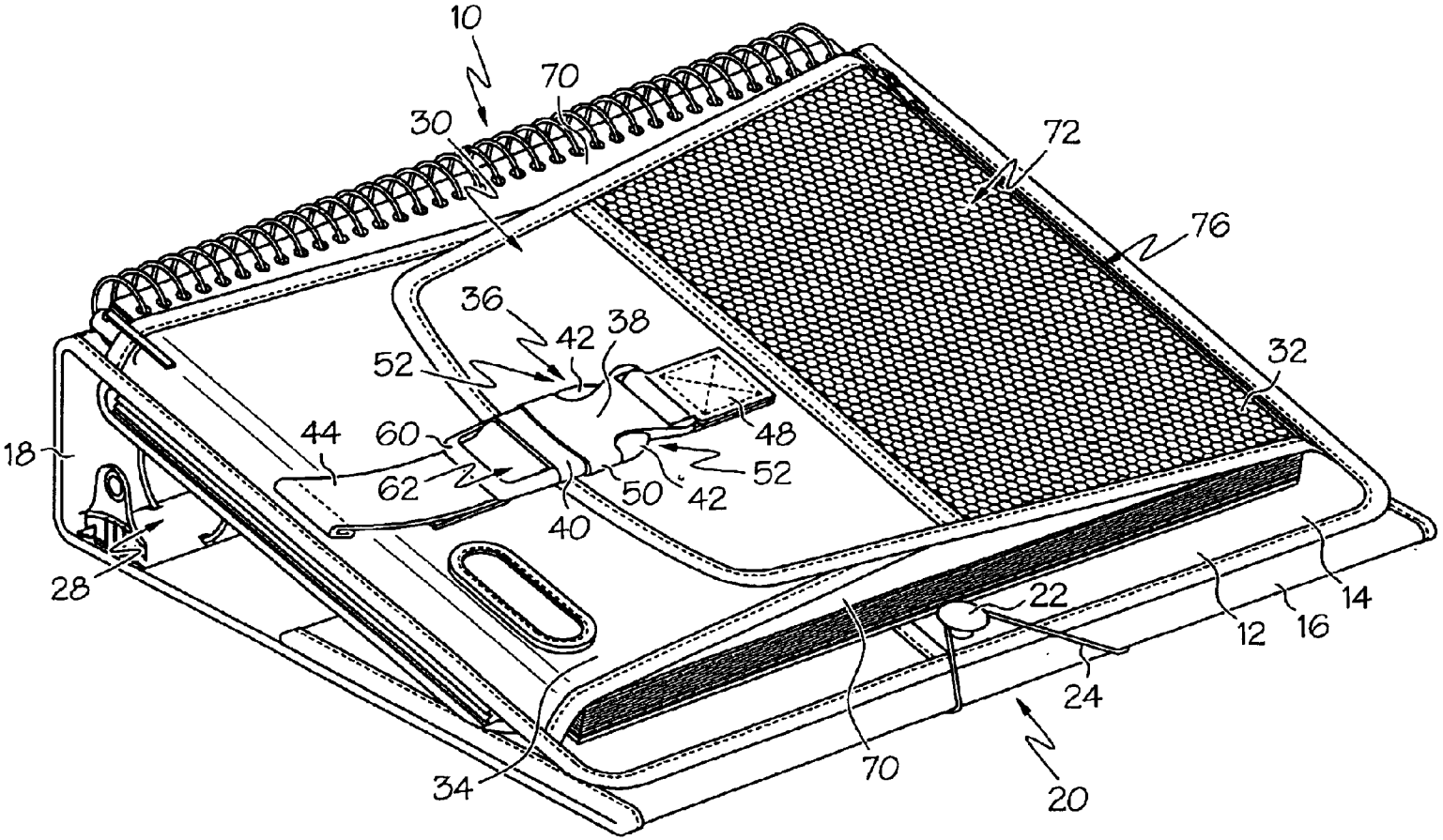
FIG. 5 is a front perspective view of the binder of FIG. 1, illustrating various loose components stored by the retaining mechanism.

In order to utilize or operate the retaining mechanism 30, the clasp components 38, 40 or attachment mechanism 36 are first separated as shown in FIG. 2. The upper 32 and lower 34 panels are then pivoted to their access positions (FIGS. 3 and 4). Next, various loose components 70 which are desired to be stored are located on the front cover 14. The panels 32, 34 are then pivoted inwardly until the panels 32, 34 engage the loose component(s), and the panels 32, 34 are then coupled together by the attachment mechanism 36. As shown in FIG. 5, various sizes of the loose components 70 can change the spacing between the clasp components 38, 40, and the adjustable length feature of the attachment mechanism 36 (i.e., adjustable belt 44) enables the retaining mechanism 36 to grip and accommodate loose components 70 of various sizes and shapes. Thus, nearly any adjustable attachment mechanism 36, including an attachment mechanism including belts or other portions made of elastic or other materials, or strips of hook and loop fastening material located on the panels 32, 34 can also be used.

As shown in FIG. 1, one or both of the panels 32, 34 may include a pocket 72 located on an outer surface thereof, and as shown in FIGS. 3 and 4, one or both of the panels 32, 34 may include pockets 74 located on a lower surface thereof. Each of the pockets 72, 74 may include a releasable closure, such as a zipper 76, to control access to the inner cavity of the pockets. Furthermore, the front cover 14 may include a pocket 78 located thereon which can, for example, be accessed when the panels 32, 34 are pivoted to their access position.

The retaining mechanism 30 provides a conveniently located and easily accessible storage feature. For example, books, notebooks, loose-leaf papers and the like may be easily retained by the retaining mechanism 30 (i.e., gripped between the retaining mechanism 30 and the front cover 14). Furthermore, because the retaining mechanism 30 is located on an outer surface of the binder 10, the retaining mechanism 30 can be easily accessed without having to open the binder 10. The length of the panels 32, 34, the overlapping nature of the panels 32, 34, and the location of the hinge lines C and D adjacent to the outer edges of the binder 10 enable the retaining mechanism 30 to cover a wide surface area of the binder 10 to allow the retaining mechanism to grip and store relatively large sized items. Further, the retaining mechanism can be located on any binder, portfolio or notebook, and is not limited to use with the binder disclosed herein.

Having described the invention in detail and by reference to the preferred embodiments, it will be apparent that modifications and variations thereof are possible without departing from the scope of the invention.

What is claimed is:

1. A binder, notebook or portfolio comprising:

a body having a front cover and a rear cover pivotally joined together; and a retaining mechanism located on an outer surface of said body, said retaining mechanism including a pair of panels coupled to said body, said panels being pivotally coupled to one of said front or rear covers and being releasably attachable together.

2. The binder, notebook or portfolio of claim 1 wherein said body includes a spine portion located between said front and rear covers, and wherein said retaining mechanism is coupled to one of said front or rear covers, wherein said one of said front or rear covers includes an upper edge and a lower edge, both edges extending generally perpendicular to said spine portion, and wherein each panel is pivotable about an axis that extends generally parallel to said upper edge or lower edge.

3. The binder, notebook or portfolio of claim 2 wherein each of said panels pivots about a hinge line, said hinge line of one of said panels being located adjacent to said upper edge of said one of said front or rear cover, and the hinge line of the other of said panels being located adjacent to said lower edge of said front or rear cover.

4. The binder, notebook or portfolio of claim 2 wherein each panel is pivotable between a retaining position wherein each panel is oriented generally parallel to said front or rear cover and an access position wherein each panel is not oriented generally parallel to said front or rear cover.

5. The binder, notebook or portfolio of claim 4 wherein said panels at least partially overlap when both of said panels are in said retaining positions.

6. The binder, notebook or portfolio of claim 1 wherein said panels are movable into a retaining position wherein said panels at least partially overlap.

7. The binder, notebook or portfolio of claim 1 further including an attachment mechanism for releasably attaching said panels together.

8. The binder, notebook or portfolio of claim 7 wherein said attachment mechanism includes a pair of interlockable clasp components, one of said clasp components being coupled to a first one of said panels and the other one of said clasp components being coupled to the other one of said panels.

9. The binder, notebook or portfolio of claim 8 wherein each of said clasp components are coupled to one of said panels by a belt, and wherein an effective length of at least one of said belts is adjustable.

10. The binder, notebook or portfolio of claim 1 wherein at least one of said panels includes a pocket located therein or thereon to store loose components.

11. The binder, notebook or portfolio of claim 1 wherein said binder, notebook or portfolio includes a binding mechanism coupled to an inner surface of said binder, notebook or portfolio.

12. The binder, notebook or portfolio of claim 1 wherein said front and rear covers are pivotal about a first axis and second axis, respectively, said first and second axes being generally parallel, and wherein one of said panels is pivotal about a third axes and an other one of said panels is pivotal about a fourth axes, said third and fourth axes being generally perpendicular to said first and second axes.

13. The binder, notebook or portfolio of claim 1 wherein each of said covers are generally flat and planar, and wherein said binder, notebook or portfolio includes a spine portion extending between, coupled to and generally perpendicular to said covers.

14. A binder, notebook or portfolio comprising:

a body having a front cover and a rear cover pivotally joined together; and a retaining mechanism located on an outer surface said body, said retaining mechanism including a pair of panels pivotally coupled to said body such that loose components can be located between said panels and said outer surface.

15. The binder, notebook or portfolio of claim 14 wherein said panels are releasably attachable together.

16. The binder, notebook or portfolio of claim 14 wherein said front and rear covers are pivotal about a first axis and second axis, respectively, said first and second axes being generally parallel, and wherein one of said panels is pivotal about a third axes and the other of said panels is pivotal about a fourth axes, said third and fourth axes being generally perpendicular to said first and second axes.

17. The binder, notebook or portfolio of claim 14 wherein each panel is pivotally coupled to one of said front or rear covers.

18. The binder, notebook or portfolio of claim 14 wherein said body includes a spine portion located between said front and rear covers, and wherein said retaining mechanism is coupled to one of said front or rear covers which includes an upper edge and a lower edge, both edges extending generally perpendicular to said spine portion, and wherein each panel is pivotable about an axis that extends generally parallel to said upper edge or said lower edge.

19. The binder, notebook or portfolio of claim 18 wherein each of said panels pivots about a hinge line, said hinge line of one of said panels being located adjacent to said upper edge of said one of said front or rear cover, and the hinge line of an other one of said panels being located adjacent to said lower edge of said front or rear cover.

20. The binder, notebook or portfolio of claim 14 wherein each panel is pivotable between a retaining position wherein each panel is oriented generally parallel to said front or rear cover and an access position wherein each panel is not oriented generally parallel to said front or rear cover.

21. The binder, notebook or portfolio of claim 20 wherein said panels at least partially overlap when both of said panels are in said retaining positions.

22. The binder, notebook or portfolio of claim 14 wherein said panels are movable into a retaining position wherein said panels at least partially overlap.

23. The binder, notebook or portfolio of claim 14 further including an attachment mechanism for releasably attaching said panels together.

24. The binder, notebook or portfolio of claim 23 wherein said attachment mechanism includes a pair of interlockable clasp components, one of said clasp components being coupled to a first one of said panels and an other one of said clasp components being coupled to the other one of said panels.

25. The binder, notebook or portfolio of claim 24 wherein each of said clasp components are coupled to one of said panels by a belt, and wherein an effective length of at least one of said belts is adjustable.

26. The binder, notebook or portfolio of claim 14 wherein at least one of said panels includes a pocket located therein or thereon to store loose components.

27. The binder, notebook or portfolio of claim 14 wherein said binder, notebook or portfolio includes a binding mechanism coupled to an inner surface of said binder, notebook or portfolio.

28. The binder, notebook or portfolio of claim 14 wherein each of said covers are generally flat and planar, and wherein said binder, notebook or portfolio includes a cover extending between, coupled to and generally perpendicular to said covers.

* * * * *